US007870993B2

(12) United States Patent
Walling

(10) Patent No.: US 7,870,993 B2
(45) Date of Patent: Jan. 18, 2011

(54) END DISPENSING CARTON

(75) Inventor: Bradford J. Walling, Raleigh, NC (US)

(73) Assignee: MeadWestvaco Packaging Systems, LLC, Richmond, VA (US)

( * ) Notice: Subject to any disclaimer, the term of this patent is extended or adjusted under 35 U.S.C. 154(b) by 278 days.

(21) Appl. No.: 12/055,750

(22) Filed: Mar. 26, 2008

(65) Prior Publication Data

US 2008/0237324 A1 Oct. 2, 2008

Related U.S. Application Data

(60) Provisional application No. 60/908,129, filed on Mar. 26, 2007.

(51) Int. Cl.
*B65D 5/468* (2006.01)

(52) U.S. Cl. ..... 229/117.17; 229/117.16; 206/427

(58) Field of Classification Search ..... 229/117.13, 229/117.16, 117.17, 240, 242, 122.1; 206/141, 206/427

See application file for complete search history.

(56) References Cited

U.S. PATENT DOCUMENTS 2,917,220 A * 12/1959 Bostock ..... 229/117.17
4,037,777 A * 7/1977 Maughan ..... 229/117.17
4,372,477 A * 2/1983 Wytko ..... 229/173
4,637,515 A * 1/1987 Wilson et al. ..... 206/434
4,967,901 A 11/1990 Wood
5,222,658 A * 6/1993 DeMaio et al. ..... 229/117.13
5,228,589 A * 7/1993 Della Riva ..... 206/229
5,271,551 A * 12/1993 Roepke ..... 229/117.17
5,316,210 A * 5/1994 Scullin ..... 229/117.16
2003/0234283 A1* 12/2003 Dowd ..... 229/117.17
2007/0295791 A1* 12/2007 Gomes et al. ..... 229/122
2009/0173773 A1* 7/2009 Blin ..... 229/117.16

* cited by examiner

*Primary Examiner*—Gary E Elkins
(74) *Attorney, Agent, or Firm*—MWV Intellectual Property Group

(57) ABSTRACT

A carton for packaging articles can be carried and unloaded in an upright condition. The carton is formed as an elongated tubular structure with opposed open ends. An end wall partially closes the first open end. At least one edge of the end wall is free from the tubular structure so as to define an open region therebetween that facilitates grasping the end wall for removal of the end wall to reveal the articles for dispensing. A handle formed from at least one aperture is positioned proximate to the detachable end wall to facilitate carrying of the carton in an upright condition with the dispensing end up. An end flap is hingedly connected to the tubular structure includes a second aperture that is reinforcingly aligned with the first aperture.

11 Claims, 4 Drawing Sheets

END DISPENSING CARTON

CROSS REFERENCE TO RELATED APPLICATIONS

This application claims priority to U.S. Provisional Application No. 60/908,129, filed Mar. 26, 2007, the entirety of which is incorporated herein by reference.

TECHNICAL FIELD

This invention relates generally to packaging, and more specifically, the invention relates to end dispensing cartons for transporting articles as an alternative to plastic trays for transporting articles.

BACKGROUND OF THE INVENTION

Plastic trays are often used to transport multiples of articles to a location where the articles are disposed for individual handling. In particular, plastic trays are used to transport beverage containers such as cans or bottles to points of purchase such as retail establishments or vending machines for sale as individual articles. Beverages that are sold in individual units at points of purchase are typically transported to the points of purchase in plastic tray.

A shortcoming of transporting articles in plastic trays is that the trays require extensive handling after they have been unloaded. Typically, the trays must be transported back to the place of loading, must be stored, and may have to be cleansed before being used again. Oftentimes, plastic trays are lost or inadvertently left behind after a delivery is made. Thus, the handling requirements and the potential for loss add costs to the process of stocking the points of purchase. It can be appreciated that it would be useful to have a means for simplifying and reducing the cost of transporting individual articles to points of purchase.

Therefore, a heretofore unaddressed need exists in the industry to address the aforementioned deficiencies and inadequacies.

SUMMARY

The various embodiments of the present invention overcome the shortcomings of the prior art by providing carton that is a low-cost, easy-to-handle alternative to plastic trays for transporting quantities of individual articles such as beverage bottles and cans. The carton is lightweight but durable enough to accommodate the weight of multiples of beverage bottles or cans. Advantageously, the loaded carton is ergonomically configured to be carried in an upright vertical carrying condition in which the distribution of the weight is optimized and placement of the hand-grip apertures makes it easier to carry the package with one or both hands. The loaded carton can rest on one end and be unloaded from the other end, thereby reducing the need to stoop to reach the articles within. The carton can be open ended or may include an end wall that is detachable to reveal the articles for unloading.

The carton, once emptied, is easily collapsed so as to take up less space and be easily manipulated. Thus, the empty carton can be transported, stored or disposed of, or can be handled in a combination of these options. The empty carton can ultimately be disposed of by methods that include recycling as a paper product, placement in a trash container, burning, or any means suitable for disposing of substantially flat paperboard products. Thus, the empty carton provides a range of post-emptying options not available with plastic trays.

An additional advantage provided by the teachings of the present invention is that the carton may be loaded and handled in much the same manner as typical consumer-directed multi-packs for articles such as bottles and cans. In particular, the carton as taught by the invention may be loaded on typical Out-Plant Equipment ("OPE") that is used to end-load and seal beverage multi-packs.

According to an exemplary embodiment of the present invention, a carton includes a plurality of walls that form a tubular structure. The tubular structure includes opposed open ends, a longitudinal axis of the carton extending between the opposed open ends, a continuous end edge adjacent a first one of the opposed open ends, and a first aperture formed proximate to the continuous end edge. The first aperture is elongated along a first axis that is transverse with respect to the longitudinal axis of the carton. The first open end is at least partially closed by the end wall. At least one edge of the end wall is offset from the continuous end edge of the tubular structure so as to define an open region therebetween. The open region is proximate to the first aperture.

The carton is useful for packaging a plurality of elongated articles. For example, each of the articles can be elongated along a second axis and disposed in the carton such that the second axes are substantially parallel to the first axis of the first aperture. The first aperture is positioned between a first tier of articles that are disposed adjacent the end wall and a second tier of articles that are adjacent the first tier of articles. Alternatively, the first axis can be spaced apart from the continuous end edge by a distance substantially equal to the diameter of an article.

According to one aspect of the disclosure, the first aperture and the open region are dimensioned and positioned such that a user can grasp the portion of the tubular structure defined therebetween.

According to another aspect of the disclosure, the carton further includes at least one end flap hingedly connected to the tubular structure along a portion of the continuous end edge and in flat face contact with the tubular structure. The at least one end flap includes a second aperture that is aligned with the first aperture.

According to another aspect of the disclosure, the end wall includes a first panel and a second panel, each hingedly connected along a portion of the continuous end edge. In certain embodiments, the hinged connections between the tubular structure and each of the first panel and the second panel are provided by frangible lines. In alternative embodiments, it is contemplated that the end is alternatively detachable from the carton.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
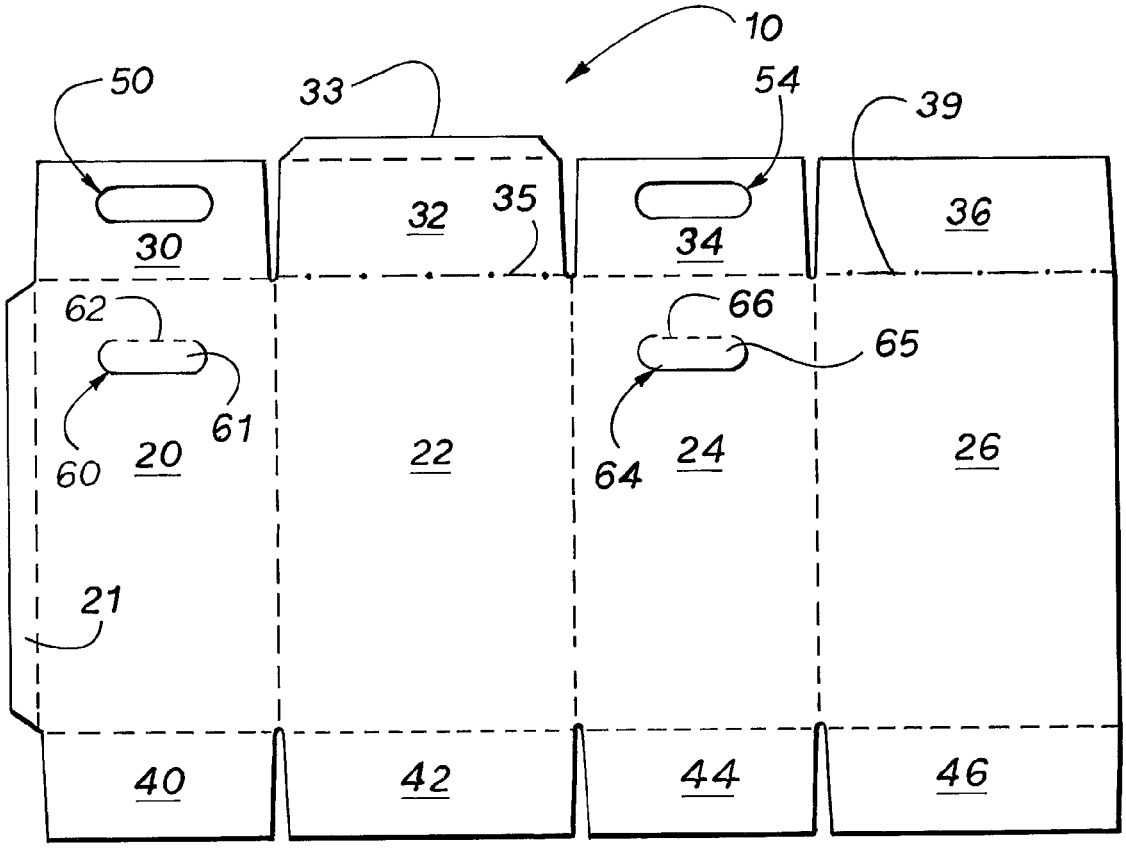
FIG. 1 is a plan view of a blank for forming a carton for transporting articles, according to an exemplary embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, certain of the various aspects of exemplary embodiments of a carton are illustrated.

As used herein, the terms "fold line" and "frangible line" refer to all manner of lines indicating optimal respective fold or cut locations. A fold line is typically a scored line, an embossed line or a de-bossed line. Frangible lines, and sometimes fold lines, may be weakened lines, perforations, a line of perforations, a line of short slits, a line of half-cuts, or a single half-cut. A frangible line may also be a cut line or slit. Fold lines and frangible lines may also be some combination of the above lines, and the like.

Figure 5:
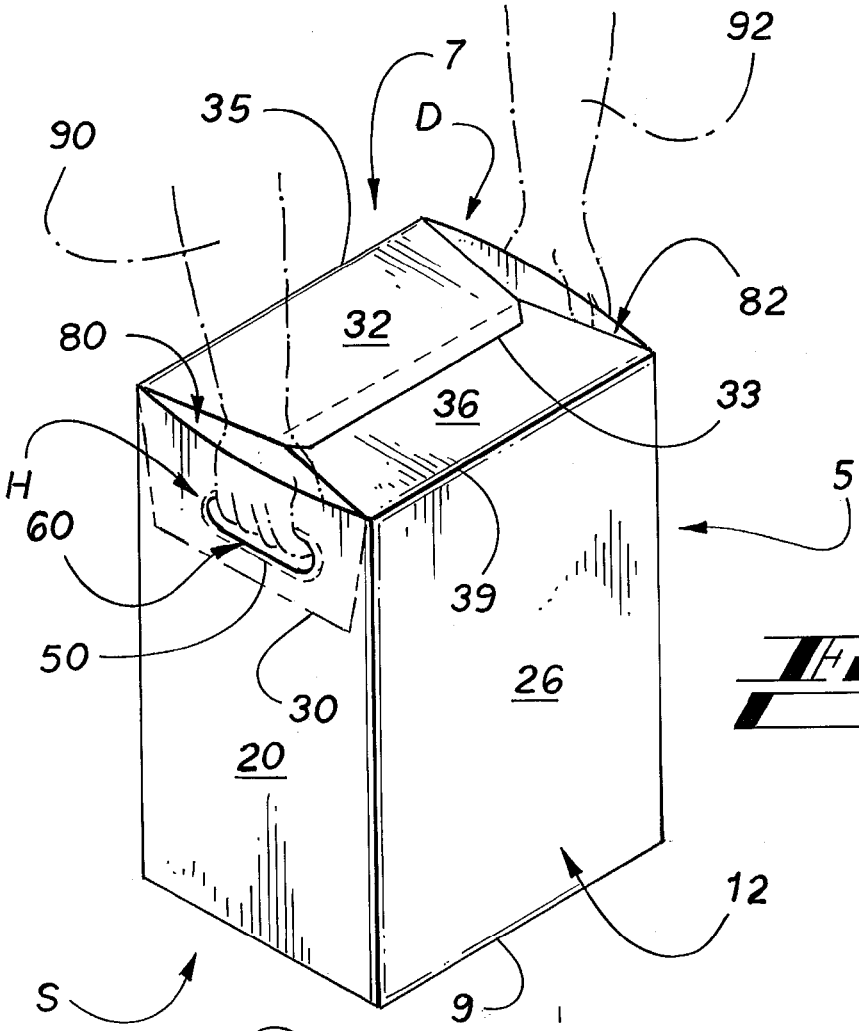
FIG. 5 is a perspective view of the fully enclosed carton of FIG. 4, upended for transporting articles, according to an exemplary embodiment of the present invention.

Referring first momentarily to FIG. 5, an exemplary embodiment of a package 5 formed in part by a carton 12 made from a substrate, provides an alternative to plastic trays for transporting multiple articles, according to the present invention. Referring now to FIG. 1, an exemplary embodiment of a blank 10 for forming a carton 12, and in turn a package 5, according to the present invention has a series of foldably interconnected panels.

The illustrated blank and carton are constructed of a single sheet of substrate. Suitable substrates include, but are not limited to, all manner of foldable sheet material such as paperboard, corrugated board, cardboard, plastic, or the like. The blank and carton may include a water resistant coating on at least one surface. In the illustrated embodiment, the blank is particularly designed for packaging beverage containers such as bottles; however, the teachings of the invention contemplate that other articles and/or different arrangements of articles may be contained within the carton and that the blank may therefore be sized accordingly.

The illustrated embodiment contemplates using paperboard as the substrate. Paperboard with a caliper in a range of about 0.024 point to about 0.028 point board is appropriate, but not the only suitable weight or caliper of substrate.

For purposes of orientation and description, the blank is considered to be viewed from an interior surface. In the description that follows, each fold line is not specifically enumerated. In the accompanying drawings, fold lines are denoted by a dash line or interrupted line. On the other hand, frangible lines 35, 39 are specifically enumerated and are depicted by what may be considered a dot-dashed line. The frangible lines 35, 39 are specifically enumerated to help distinguish over the fold lines that are typically not specified herein.

Figure 3:
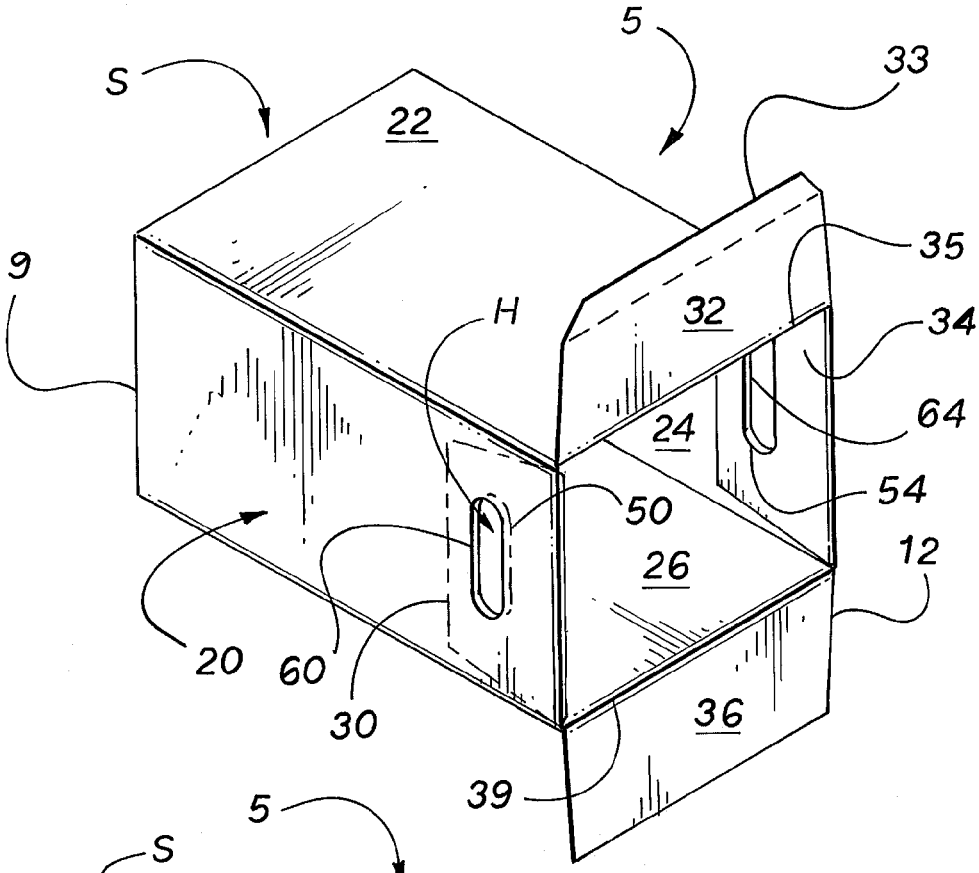
FIG. 3 is a perspective view of the erected carton of FIG. 2, according to an exemplary embodiment of the present invention.
Figure 4:
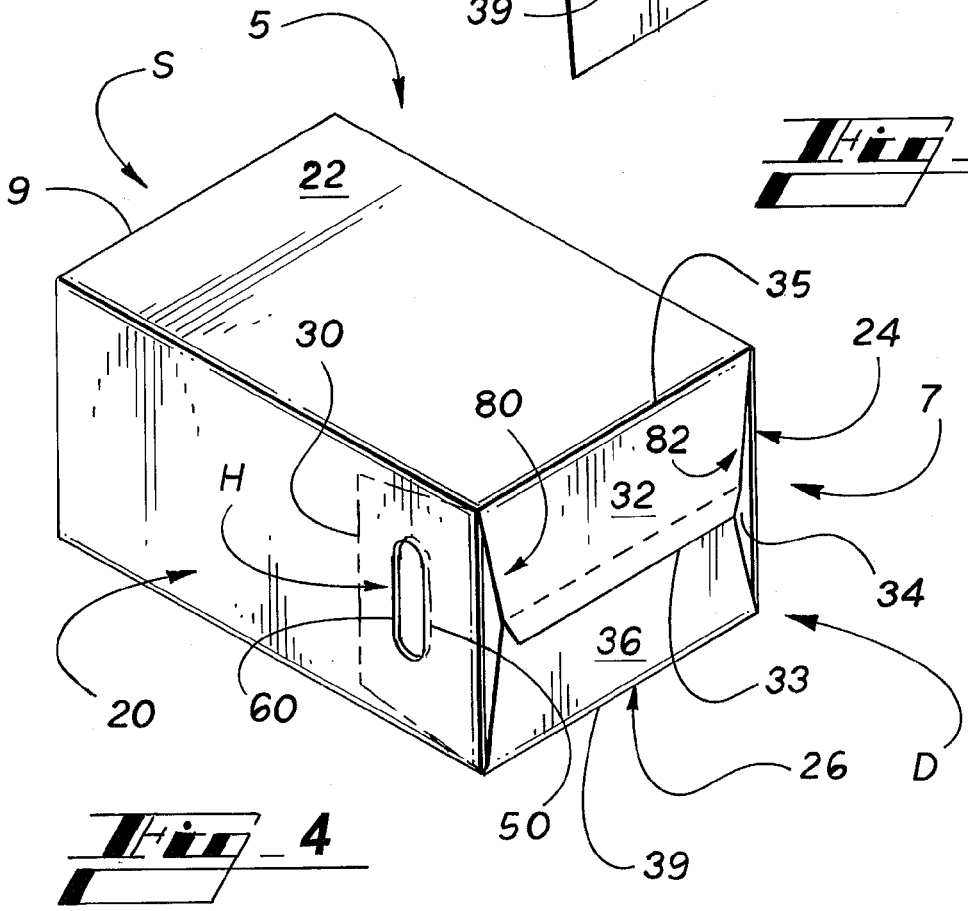
FIG. 4 is a perspective view of the erected carton of FIG. 3 with end flaps of the carton overlapped and joined to form an end closure for the carton, according to an exemplary embodiment of the present invention.

A first panel 20 is referred to herein as a first side panel 20 as a point of reference. A top panel 22 is foldably adjoined to the first side panel 20 along one edge and foldably adjoined to a second side panel 24 along a second edge. The second side panel 24 foldably adjoins a base panel 26 along the other edge of the second side panel 24. In an erected carton 12, these major panels, that is, side 20, 24, top 22 and base 26 panels, form a substantially tubular structure with opposed open ends. The tubular structure is elongated such that the distance between the open ends is greater than the distance between opposed panels or walls of the tubular structure. An adjoinment flap 21 is foldably joined to the free edge of the first side panel 20 to facilitate formation of the tubular structure. The adjoinment flap 21 may be joined to the base panel 26 by adherence or other suitable means of joinder. The terms "top" and "base" are used to describe the orientation of these panels or walls of the carton when oriented for loading as shown in FIGS. 3 and 4. When the carton is upended as shown in FIG. 5, the "top" and "base" panels or walls can be considered side panels or walls. In other words, the terms "side," "top" and "base" facilitate description and are not intended to be limiting.

End flaps are foldably joined respectively to the opposing ends of the major panels 20, 22, 24, 26. First side end flaps 30, 40 are foldably joined respectively to the opposing ends of first side panel 20. Top end flaps 32, 42 are foldably joined respectively to the opposite ends of the top panel 22. A joinder flap 33 is foldably joined to the free edge of the top end flap 32. Second side end flaps 34, 44 are foldably joined respectively to the ends of the second side panel 24. Base end flaps 36, 46 are foldably joined respectively to the ends of the base panel 26.

For purposes of clarity, the end of the blank 10 and carton 12 where hand-grip apertures 50, 54, 60, 64 (described below) are disposed is referred to as the dispensing end D and the opposite end of the blank 10 and 12 is referred to as the set end S.

The top end flap 32 and the base end flap 36, located at the grip end of the blank 10, can be respectively foldably adjoined to the top panel 22 and base panel 26 along frangible lines 35, 39 of joinder. The frangible lines of joinder 35, 39 facilitate removal of the two end flaps 32, 36 when the carton 12 is in an erected, loaded, and closed condition as will be described in greater detail below.

A flap aperture 50, 54 is formed in each side end flap 30, 34. A side-wall aperture 60, 64 is formed in each respective side wall 20, 24. The flap apertures 50, 54 and the side wall apertures 60, 64 correspond to one another and are disposed for alignment with one another when each side end flap 30, 34 is placed in face-contacting condition with, and optionally adhered to, the inside surface of a respective side wall 20, 24, thereby forming a reinforced handle H as shown in FIG. 2.

A handle flap 61, 65 foldably adjoined along respective fold lines 62, 66 may be used to cover each side wall aperture 60, 64 and, in addition, may serve as a cushion when pushed through a respective side wall aperture 60, 64. For purposes of illustration, handle flaps 61, 65 are not shown in FIGS. 3-7.

Figure 2:
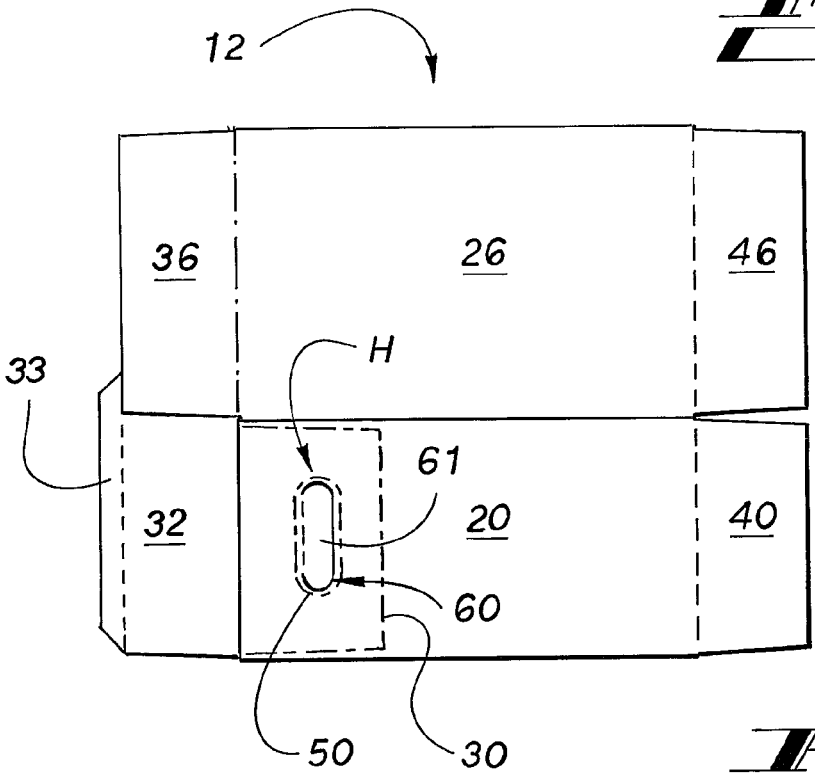
FIG. 2 is a plan view of a carton in collapsed condition, formed from the blank of FIG. 1, according to an exemplary embodiment of the present invention.

Referring to FIGS. 1 and 2, an exemplary method of folding and securing the blank 10 of FIG. 1 to partially form the carton 12 as a collapsed tubular structure is described. As described in further detail below, the collapsed tubular structure can be erected, loaded, and secured to form a package. The carton 12 is partially formed as a tubular structure in collapsed condition in FIG. 2. The collapsed tubular structure is formed by joining the free ends of the major panels, that is, the free ends of the blank 10, that is, free ends of the first side panel 20 and the base panel 26. The adjoinment flap 21 may be used to adjoin the first side panel 20 to the base panel 26. Adjoinment may be made by adherence or other suitable methods of adjoining substrate material. In the collapsed condition shown in FIG. 2, the top end flap 32 is seen from its interior surface whereas the other panels and flaps shown are seen from their exterior surfaces. The side end flap 30 is shown with hidden lines as both side end flaps 30, 34 (see FIG. 1) at the dispensing end D (FIGS. 4-6) of the blank 10 are folded inwardly into flat-face condition with their respective side panels 20, 24 prior to loading the carton 12.

Referring to FIG. 3, the carton 12 is erected from a collapsed condition and can be end loaded with articles such as bottles 1 (shown in FIG. 6) to form a package 5. In the erected condition, the panels 20, 22, 24, 26 define walls of the tubular structure. Accordingly, hereinafter, panels 20, 22, 24, 26 are referred to as walls 20, 22, 24, 26. Additionally, the fold lines hingedly connecting the walls 20, 22, 24, 26 and the respective side end flaps at one end of the tubular structure can be considered to define a continuous end edge of the tubular structure. The side end flaps 30, 34 are shown as folded inward into flat-face condition with respective side walls 20, 24. The top end panel 32 and base end panel 36 are shown folded into substantially perpendicular disposition with respect to the erected tubular structure to facilitate loading such as by means of typical out-of-plant equipment ("OPE") used at a packaging facility.

Referring to FIGS. 3 and 4, the ends of the loaded carton 12 are closed to form a fully-enclosed package 5. In forming a fully-enclosed carton 12, the various end flaps 40, 42, 44, 46 (shown in FIGS. 1 and 2) at the set end S of the carton 12 are folded over and adjoined, such as by adherence or other conventional means for adjoining substrates, to form an end closure or end wall 9. Closure 9 may be formed at the set end S of the carton either prior to or after articles 1 (bottles) have been loaded into the carton 12. The closure 9 of the carton 12 is not visible from the point of view of FIGS. 3 and 4.

At the dispensing end D of the carton 12, the side-panel end flaps 30, 34, once folded into flat-face condition with respect to their respective side walls 20, 24, help form reinforced handles H, prior to loading of the carton 12. This leaves only the top end flap 32 and the base end flap 36 at the dispensing end D of the carton 12 to be joined. An end wall or end closure 7 is formed by closure and joinder of the top end flap 32 and base end flap 36. These two end flaps 32, 36 may be joined by adherence of similar affixation of top joinder flap 33 to the base end flap 36. The end wall 7 may be removed by tearing along the frangible lines 35, 39. It should again be noted that in FIGS. 3 and 4, the handle flaps 61, 65 are not shown.

As shown in FIGS. 4 and 5, spaces 80, 82 are formed at the region of the intersection of the planes of the side wall 20, 24 and the end wall 7 formed by the joinder of the top end flap 32 and the base end flap 36. The invention teaches that tapering of the top end flap 32 and base end flap 36 can facilitate formation of the spaces 80, 82. The side panels 20, 24 may bow outward slightly as the carton 12 is erected and loaded. The dimensions of the blank 10 and the carton 12 may be selected to facilitate such bowing. For example, side walls 20, 24 are dimensioned with respect to article (bottle 1) heights to provide a slack enclosure rather than a tight enclosure. The spaces 80, 82 can be useful to facilitate grasping and lifting of the package 5 (shown in FIG. 5), and further, provide access to quickly and easily grasp and remove the end wall 7. Additionally, or alternatively, the spaces 80, 82 can be formed or further enlarged by contouring the free edges of the end wall 7 or of the side walls 20, 24.

Referring to FIG. 5, the package 5 is upended and set upon the set end S having the end wall 9 that has been formed from the end flaps 40, 42, 44, 46. In this upended condition, the walls 20, 22, 24, 26 are considered side walls and the handles H formed by hand-grip apertures 50, 54, 60, 64 may be grasped by the hands 90, 92 of an individual to lift and transport the package 5. Advantageously, the topmost tiers T1, T2 of articles can easily be reached for removal with the package resting on the ground without excessive bending, and the package then can be at least partially unloaded and thereby lightened before being lifted to an even more ergonomic height to complete unloading.

Referring to FIG. 5, the end wall 7 may be removed by tearing along the frangible lines 35, 39 to place the upended package in condition for unloading.

Figure 6:
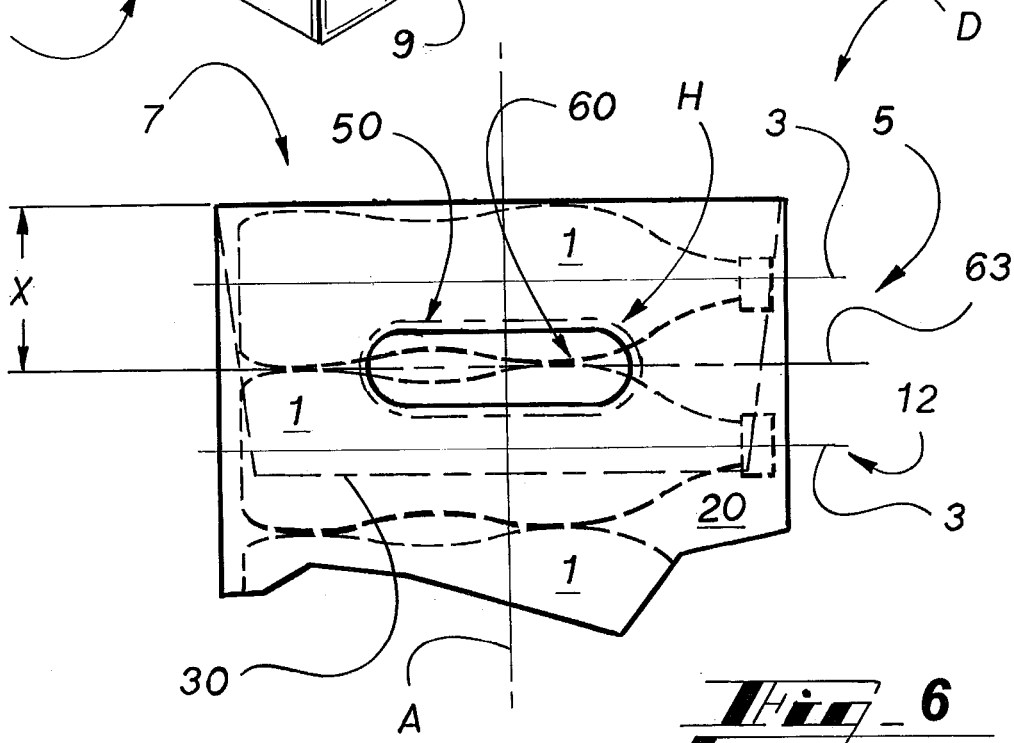
FIG. 6 is a side elevation view of the upended carton of FIG. 5, illustrating the position of a hand grip aperture with respect to articles packaged by the carton, according to an exemplary embodiment of the present invention.

FIG. 6 illustrates the parallel alignment of the elongated handle H and bottles 1 (elongated articles) with respect to one another. The hand-grip aperture 60 is elongated along a hand-grip axis 63, while each bottle 1 is an elongated article elongated along a bottle axis 3. The axes 3 of the bottles 1 are in parallel alignment with the hand-grip axis 63. Further, the bottle axes 3 and hand-grip axis 63 are substantially perpendicular to a longitudinal or tubular axis A of the carton 12 that extends between the ends S, D of the carton 12.

Figure 7:
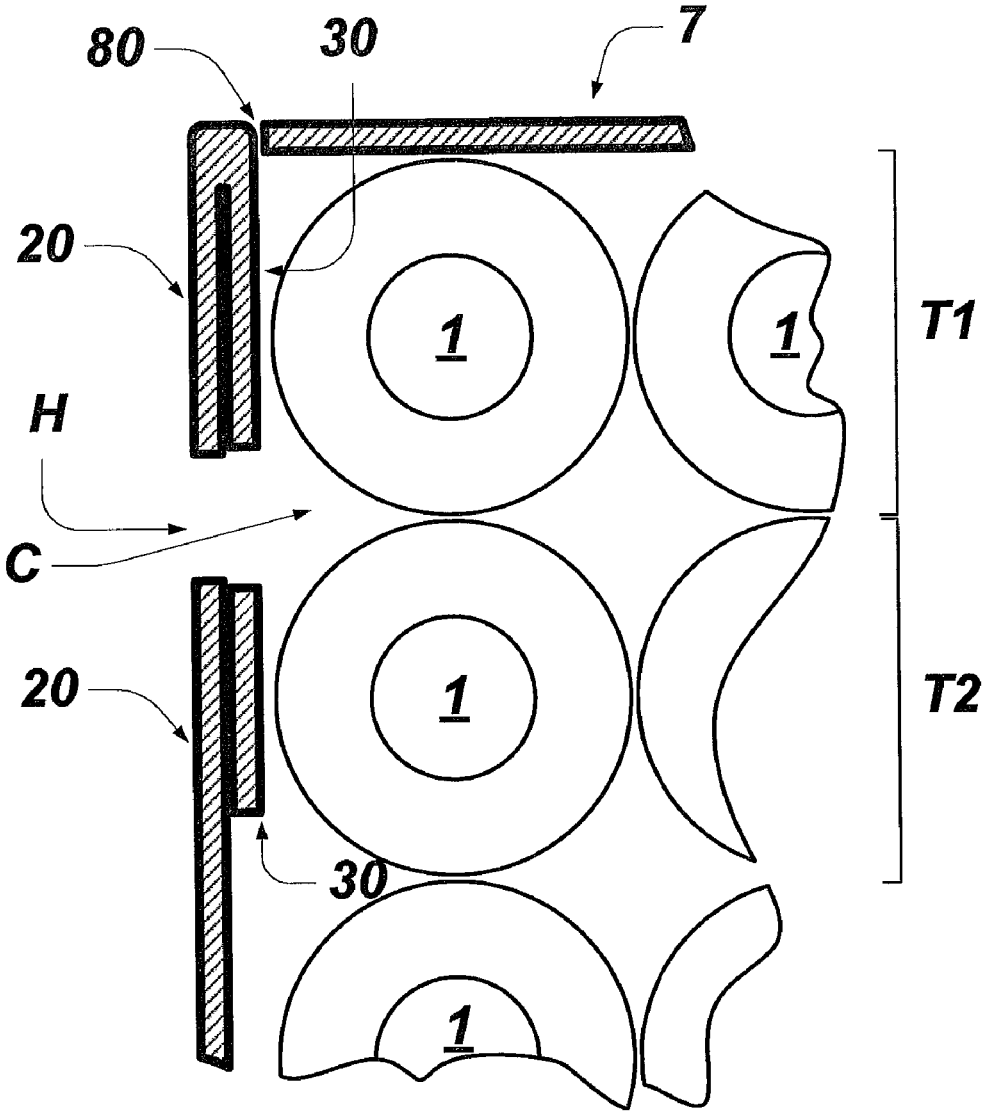
FIG. 7 is an end elevation view of the upended carton of FIG. 5, illustrating the position of a hand grip aperture with respect to articles packaged by the carton.

The hand grip axis 63 is spaced apart from the end wall 7 or fold line hingedly connecting the side wall 20 and the side end flap 30 by a distance X that is substantially equal to the diameter of a bottle B. Referring to FIG. 7, positioning the hand-grip apertures 60, 64 in this manner provides that the handles H are adjacent a space C defined by the walls of adjacent bottles B. A user can thereby more easily insert a hand through the apertures 60, 64.

The carton 12 and package 5 of the invention provide a low-cost, easy-to-handle alternative to plastic trays to transport quantities of individual articles such as beverage bottles and cans. The package 5 formed with the carton 12 is lightweight but durable enough to accommodate the weight of multiples of beverage bottles or cans. The distribution of the weight of the package 5 in upright vertical carrying condition and placement of the hand-grip apertures 50, 54, 60, 64 make the package more ergonomically advantageous for a user to lift and transport.

The carton 12, once emptied, is easily collapsed into the condition illustrated in FIG. 2. The collapsed carton 12 is lighter, takes up less space and can be manipulated easier than plastic trays. Thus, the empty carton 12 can be transported, stored or disposed of, or can be handled in a combination of these options.

The empty carton 12 ultimately may be disposed of by methods that include recycling as a paper product, placement in a trash container, burning, or any means suitable for disposing of substantially flat paperboard products. Thus, the empty carton 12 provides a range of post-emptying options not available with plastic trays.

An additional advantage provided by the teachings of the present invention is that the carton may be loaded and handled in much the same manner as typical consumer-directed multi-packs for articles such as bottles and cans. In particular, the carton 12 as taught by the invention may be loaded on typical out-of-plant equipment ("OPE") that is used to end-load and seal beverage multi-packs.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A package, comprising: a plurality of articles; and a carton for enclosing the plurality of articles, comprising: a plurality of side walls forming a tubular structure having first and second opposed ends; a pair of first and second end walls disposed to at least partially enclose the first and second ends respectively; and a handle comprising a first aperture defined in one of the plurality of side walls, the handle being positioned proximate to the first end and oriented to enable carrying of the carton with the first end up, wherein the tubular structure defines a tubular axis that extends between the first and second ends, and the handle defines an axis of elongation extending substantially perpendicularly to the tubular axis, and wherein each of the articles defines an axis of elongation that is substantially parallel to the axis of elongation of the handle.

2. The package of claim 1, wherein the carton further comprises at least one end flap hingedly connected to the tubular structure and disposed in flat face contact with the tubular structure to reinforce the handle.

3. The package of claim 2, wherein the at least one end flap comprises a second aperture that is aligned with the first aperture.

4. The package of claim 1, wherein the carton is provided with an open region between the first end wall and the one of the plurality of side walls in which the handle is defined.

5. The package of claim 4, wherein the first aperture and the open region are dimensioned and positioned such that a user can grasp the portion of the tubular structure defined between the first aperture and the open region.

6. The package of claim 1, wherein the first end wall is detachable to dispense the articles.

7. A package, comprising: a plurality of articles; and a carton for enclosing the plurality of articles, comprising: a plurality of side walls forming a tubular structure having first and second opposed ends; a pair of first and second end walls disposed to at least partially enclose the first and second ends respectively; and a handle comprising a first aperture defined in one of the plurality of side walls, the handle being positioned proximate to the first end and oriented to enable carrying of the carton with the first end up, wherein the tubular structure defines a tubular axis that extends between the first and second ends, and the handle defines an axis of elongation extending substantially perpendicularly to the tubular axis, and wherein the axis of elongation of the handle is spaced apart from the first end by a distance substantially equal to the diameter of each of the articles.

8. A package, comprising: a plurality of articles; and a carton for enclosing the plurality of articles, comprising: a plurality of side walls forming a tubular structure having first and second opposed ends; a pair of first and second end walls disposed to at least partially enclose the first and second ends respectively; and a handle comprising a first aperture defined in one of the plurality of side walls, the handle being positioned proximate to the first end and oriented to enable carrying of the carton with the first end up, wherein the handle is positioned between first and second tiers of the articles, the first tier being disposed adjacent to the first end wall, the second tier being adjacent the first tier of the articles such that the first tier is disposed between the first end wall and the second tier.

9. A carton, comprising: a plurality of side walls forming a tubular structure having first and second opposed ends; first and second end walls disposed to at least partially enclose the first and second ends respectively, articles received within the carton, the first end wall being detachable for dispensing the articles from the carton; and a handle provided by a first aperture in one of the plurality of side walls proximate to the first end, wherein an open region is defined between the first end wall and the one of the plurality of side walls, wherein the first aperture and the open region are dimensioned and positioned such that a user can grasp the portion of the tubular structure defined between the first aperture and the open region, wherein the tubular structure defines a tubular axis that extends between the first and second ends, and the first aperture defines an axis of elongation that is substantially perpendicular to the tubular axis, and wherein the axis of elongation of the first aperture is spaced apart from the first end by a distance substantially equal to the diameter of each of the articles packaged in the carton.

10. The carton of claim 9, further comprising at least one end flap hingedly connected to the tubular structure and disposed in flat face contact with the tubular structure to reinforce the handle.

11. The carton of claim 10, the at least one end flap comprising a second aperture that is aligned with the first aperture.

* * * * *